US005682945A

United States Patent [19]

Lehman

[11] Patent Number: 5,682,945

[45] Date of Patent: Nov. 4, 1997

[54] HEAT EXCHANGER WITH BRAZED PLATES AND CORRESPONDING PROCESS FOR TREATING A DIPHASE FLUID

[75] Inventor: Jean-Yves Lehman, Maisons Alfort, France

[73] Assignee: L'Air Liquide, Societe Anonyme pour L'Etude et L'Exploitation des Procedes Georges Claude, Paris Cedex, France

[21] Appl. No.: 632,390

[22] Filed: Apr. 10, 1996

[30] Foreign Application Priority Data

Apr. 14, 1995 [FR] France ..... 95 04553

[51] Int. Cl.[6] ..... F28F 3/00

[52] U.S. Cl. ..... 165/111; 165/166; 62/903

[58] Field of Search ..... 165/111, 166; 62/903; 55/268, 269; 95/256, 257, 266, 288, 289; 96/218, 201

[56] References Cited

U.S. PATENT DOCUMENTS

| | | | |
|---|---|---|---|
| 3,792,842 | 2/1974 | Nakako et al. | 165/166 X |
| 3,797,565 | 3/1974 | Fernandes | 165/111 |
| 3,992,168 | 11/1976 | Toyama et al. | 165/166 X |
| 4,132,587 | 1/1979 | Lankenau et al. . | |
| 4,249,595 | 2/1981 | Butt . | |
| 4,599,097 | 7/1986 | Petit et al. | 165/166 |
| 5,321,954 | 6/1994 | Lehman et al. | 165/166 X |

FOREIGN PATENT DOCUMENTS 2154352 5/1973 France .

*Primary Examiner*—Leonard R. Leo
*Attorney, Agent, or Firm*—Young & Thompson

[57] ABSTRACT

The heat exchanger is of the type comprising a series of first passages (4) in which a diphase fluid circulates, each of the passages being adjacent to at least one second passage (5) for the circulation of another fluid which is a heating or refrigerating fluid. At least one of the first passages (4) comprises, in at least one region of the length thereof, an increase in the cross section of the passage and means (9, 11) for receiving and discharging one of the two phases of the diphase fluid.

16 Claims, 3 Drawing Sheets

HEAT EXCHANGER WITH BRAZED PLATES AND CORRESPONDING PROCESS FOR TREATING A DIPHASE FLUID

The present invention relates to a heat exchanger with brazed plates of the type comprising, a stack of plates spaced apart by corrugated fins-spacers, and a group of generally flat-shaped passages defined by said plates, namely a series of first passages for the circulation of a diphase fluid, each of which first passages is adjacent to at least one second passage for the circulation of another, heating or refrigerating, fluid.

Heat exchangers of this type permit effecting the condensation of gases and/or the evaporation of liquids by circulation, in passages adjacent to the passages for the circulation of the diphase fluid, of an auxiliary fluid which is respectively a refrigerating or heating fluid.

In order to avoid the drying of certain regions of the plates which reduces the performances of the exchanger, the evaporation of a liquid is generally only partly effected. Likewise, the operations for the condensation are often only partial, for example for cryogenic gas purification.

In these applications, it is necessary in at least one region of the length of the exchanger to be able to separate the liquid and vapour phases of the treated fluid.

In the conventional method, the two phases to be separated are sent to a free space associated with the exchanger but distinct from the structure of the latter.

An object of the invention is to achieve the separation of the phases by the structure of the exchanger itself and thereby simplify the construction of the whole of the apparatus.

To this end, the invention provides a heat exchanger of the aforementioned type, characterized in that at least one of said first passages comprises, in at least one region of the length thereof, an increase in the passage cross section, and means for receiving and discharging one of the two phases of the diphase fluid.

The heat exchanger according to the invention may comprise one or more of the following features:

the heat exchanger has an upward circulation of the diphase fluid, and one of the plates defining said first passage and the opposite plate of an adjacent second passage for the circulation of said other fluid, are upwardly extended beyond the upper end of the dividing plate of said two passages, which extends above the upper closing bar of said second adjacent passage;

the heat exchanger has an upward circulation of the diphase fluid and said second passages are upwardly defined by upper closing bars, all the plates are upwardly extended beyond the upper closing bars, and at least some of the plates, except for the end plates, are provided with apertures above the level of said closing bars;

the heat exchanger comprises, above the plates, an upper dome for receiving the gas phase of said diphase fluid;

the heat exchanger comprises, at the upper end thereof, in each interplate gap a vapour collector outlet distributor which opens onto an outlet opening, and a vapour collector box which caps all said outlet openings;

said upper closing bars are inclined;

said first passage comprises, on the upstream side of said region, an intermediate plate which reduces the free cross section thereof up to said region and which forms, with a closing semi-bar, a cavity for receiving one of the two phases of the diphase fluid;

the heat exchanger has a downward circulation of the diphase fluid, and said cavity is upwardly defined by the closing semi-bar and contains, below said semi-bar, an outlet distributor which laterally opens onto a vapour outlet opening;

said region is in the vicinity of the lower end of said first passage and said first passage is closed at its base by a closing bar which is in particular inclined and extends laterally to a liquid outlet opening;

said cavity is open towards the opper end and is defined below by the cloing semi-bar which is in particular inclined;

said first passage comprises a plurality of intermediate plates spaced apart along the length thereof.

The invention also provides a process for the treatment of a diphase fluid in a heat exchanger with brazed plates, characterized in that it comprises substantially increasing, in at least one region of the length of each passage for the circulation of the diphase fluid, the cross section provided for said diphase fluid, and one of the two phases thereof is received.

Embodiments of the invention will now be described with reference to the accompanying drawings, in which.

Figure 1:
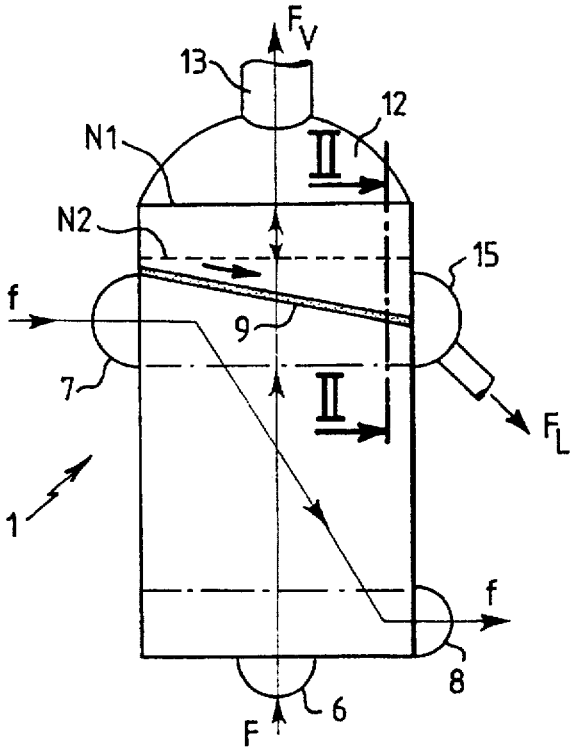
FIG. 1 is a diagrammatic view of a heat exchanger according to the invention.
Figure 2:
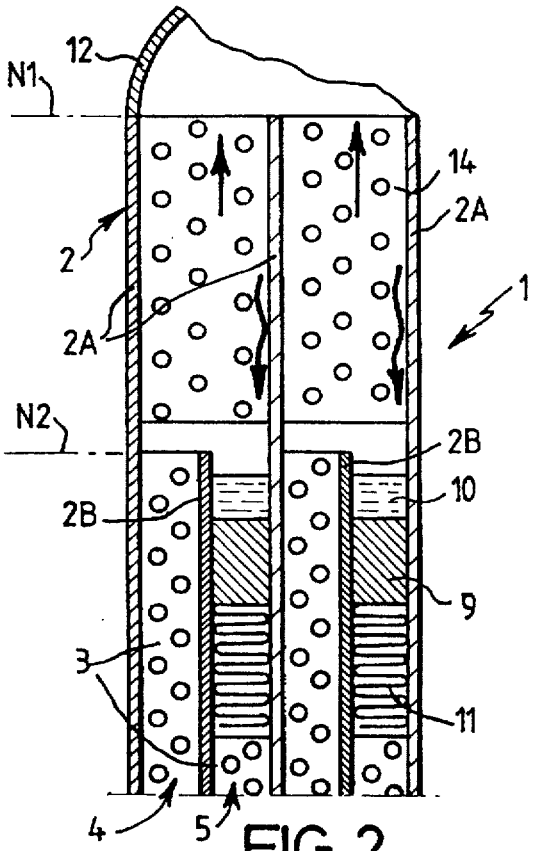
FIG. 2 is a partial sectional view, to a larger scale, taken on line II—II of FIG. 1.

The heat exchanger 1 shown in FIGS. 1 and 2 is of the type having brazed plates. It mainly comprises a parallel-sided body constituted by a stack of rectangular metal plates 2 separated by corrugated fins-spacers 3. The latter may be in particular of perforated corrugated sheets as diagrammatically represented in FIG. 2, or, in an alternative embodiment, corrugated sheets having serrations on the flanks of their corrugations, termed "serrated corrugated fins". The dimensions of the plate 2 may reach for example 6 m×2 m.

The plates 2 define therebetween a large number of generally flat-shaped passages. These passages in the illustrated embodiment are divided into two alternating groups: first passages 4 for the upward circulation of a diphase fluid F in the course of evaporation, and second passages 5 for the downward circulation of a heating fluid f. The plates 2 whose lower edges are all at the same level, extend alternately up to an upper level N1 (plates 2A) and up to a level N2 lower than N1 (plates 2B). The end plates extend up to the upper level N1.

As is well known in the art, the passages 4 and 5 are downwardly defined, on each side, by closing or sealing bars leaving free rows of inlet/outlet openings for the fluids, which are capped by inlet/outlet boxes or headers having a generally semi-cylindrical shape. Thus, there are provided a lower box 6 for the inlet of the fluid F, a lateral box 7 for the inlet of the fluid f, and a lateral box 8 for the outlet of the fluid f. Each passage 5 is upwardly defined by an upper closing bar 9 which is inclined from the upper point of the corresponding inlet opening of the fluid f. A free space 10 is defined above the bar 9 in each passage 5 between the plates 2A and 2B which are disposed on each side of the latter.

There is provided in the conventional manner in facing relation to each box or header 6 to 8 in each corresponding passage, an inlet/outlet distributor formed by an assembly of corrugated fins some of which are obliquely oriented. Thus, there is provided above each lower closing bar of the exchanger a distributor which is an inlet distributor for the fluid F in the passages 4 and a lateral outlet distributor for the fluid f in the passages 5. Further, a lateral inlet distributor 11 for the fluid f is disposed just below each upper bar 9. These distributors have been diagrammatically represented in dot-dash lines in FIG. 1.

The exchanger is completed by an upper dome 12 constructed in the conventional manner with four sheets in the shape of a quarter of a cylinder welded together at their intersections, and welded by their lower edges along the upper edge of the two end plates 2A and along the other two upper edges of the exchanger. These other two edges are, as will be understood, formed by the upper end edges of the plates 2A and of the lateral closing bars. An outlet pipe 13 for the vapour phase of the fluid F is welded to the top of the dome 12.

Only the plates 2A remain between the levels N1 and N2. These plates are then spaced apart by corrugated fins 14 whose corrugations have a height which corresponds to but a pitch which is distinctly larger than those of the corrugations of the general corrugated fins or the heat exchange corrugated fins 3.

In operation, the fluid F, supplied from the source in the liquid form to each passage 4 via the box 6, progressively evaporates. It reaches in the diphase state the level N2 where the cross section of the passage offered to the fluid suddenly increases, namely substantially doubles. The velocity of the fluid consequently suddenly decreases and this causes the separation of the liquid phase which falls by the effect of gravity. However, the rapid diphase current rising in the passage 4 has for result that the liquid does not redescend in this passage but accumulates in the cavity 10 which overlies the upper bar 9 of the associated passage 5. As this bar 9 is inclined, the liquid descends along the bar, through the liquid outlet openings provided just above the lower end of this bar, and falls into a collector box 15 which caps these outlet openings.

The vapour phase $F_v$ of the fluid F accumulates in the dome 9 and is discharged through the pipe 13.

In the alternative embodiment shown in FIG. 3, the cross section of the passages 4 is increased in the following manner: all the plates 2 are upwardly extended up to the upper level N1, and, between the levels N1 and N2, all the plates are provided with apertures 16, except of course for the two end plates.

Beyond about the level N2, the plates 2 may be spaced apart be means of a corrugated fin 17 whose corrugations have the same height as those of the heat exchange corrugated fins 3 but a larger pitch so as to increase the open cross section offered to the fluid F.

Consequently, beyond the level N2, the stack of plates 2 forms a continuous space which substantially doubles the cross section offered to the rising diphase fluid. Bearing in mind the velocity of this fluid in the passages 4, the liquid falls back solely in the regions above the bars 9 and, by trickling, accumulates in the cavity 10 before being laterally discharged, as before.

Figure 3:
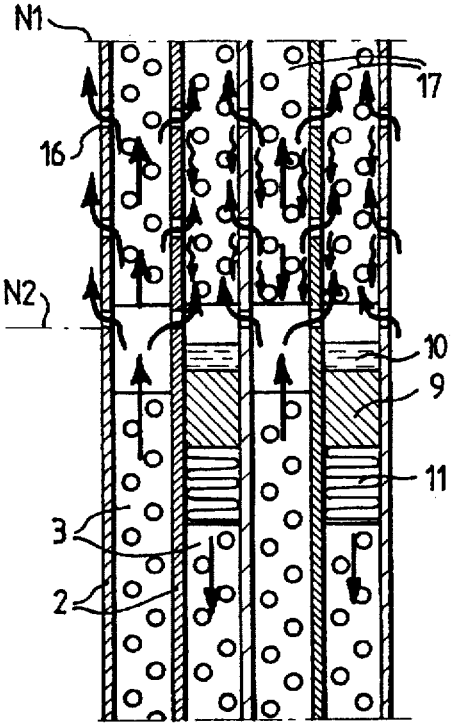
FIG. 3 is a view similar to FIG. 2 of an alternative embodiment.
Figure 4:
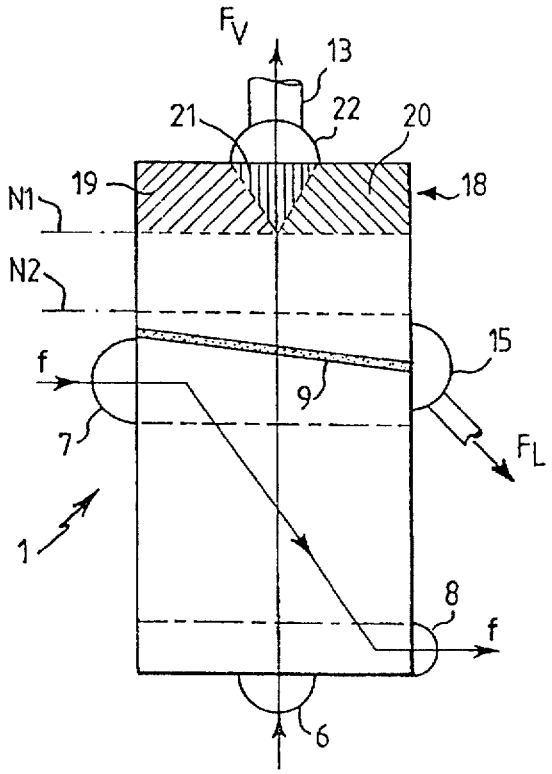
FIG. 4 is a view similar to FIG. 1 of another alternative embodiment.

FIG. 4 represents diagrammatically an alternative embodiment of the heat exchanger which is applicable both to the structure of FIG. 2 and to that of FIG. 3, since it only concerns the means for discharging the vapour $F_v$.

The dome 12 is eliminated in the structure of FIG. 4 and the plates 2A (in the case of FIG. 2) or 2 (in the case of FIG. 3) are upwardly extended beyond the level N1. Above the level N1 in each phase separating passage, that is, in each of the passages defined between the plates 2A (FIG. 2) or 2 (FIG. 3), there is provided an outlet distributor 18 adapted to return the vapour $F_v$ to the median region of the passage. As can be seen in FIG. 4, the distributor 18 comprises two oblique corrugated fins 19, 20 which are upwardly convergent up to a vertical median triangular-shaped corrugated fin 21 which has its apex pointing downwardly. This corrugated fin 21 opens onto an upper outlet opening and all of the outlet openings are capped by an outlet box or header 22 which has a generally semi-cylindrical shape and from which the pipe 13 leads.

The arrangement shown in FIG. 4 permits treating diphase fluids at high pressures for which the upper dome 12 is no longer acceptable.

Figure 5:
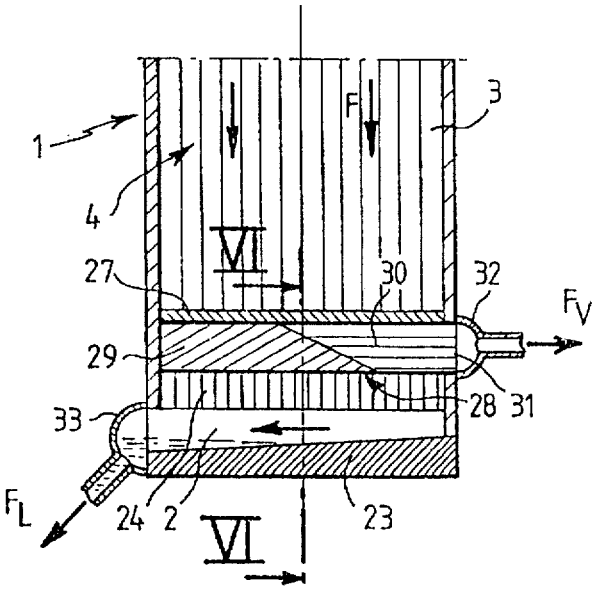
FIG. 5 is a partial longitudinal sectional view of another alternative embodiment of the heat exchanger according to the invention.
Figure 6:
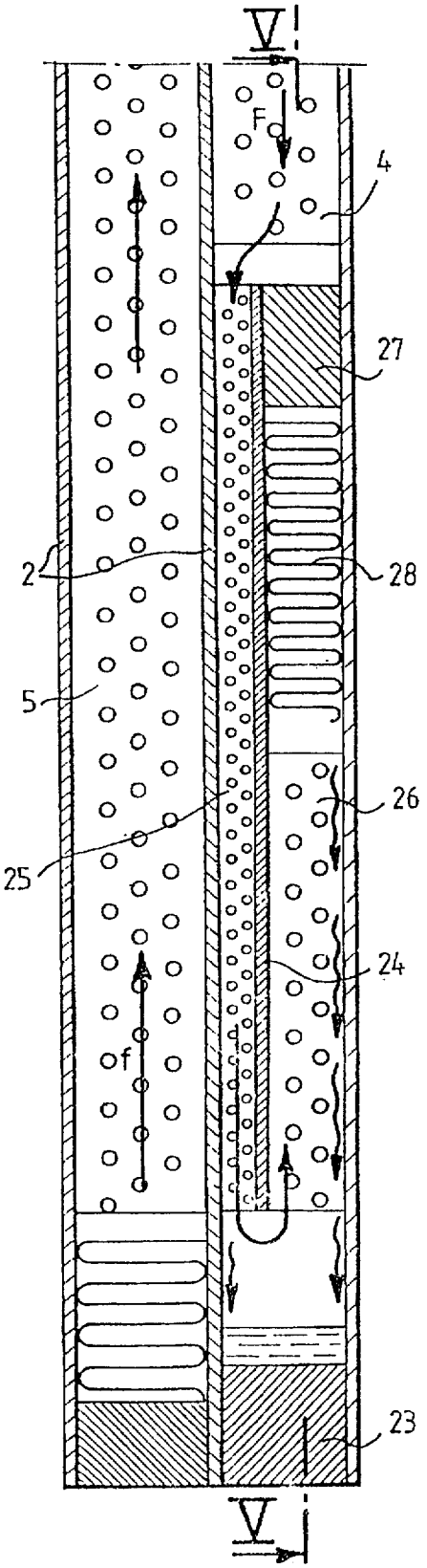
FIG. 6 is a partial sectional view taken on line VI—VI of FIG. 5.

FIGS. 5 and 6 illustrate a possibility of adapting the invention to the case of a descending diphase fluid F, for example in the course of the partial cross current evaporation of a rising auxiliary heating fluid f (FIG. 6).

Each passage 4 is closed at its lower end by a lower closing or sealing bar 23 having an inclined upper face. An intermediate plate 24 divides the passage 4 into two sub-passages 25, 26 beyond a region spaced from the bar 23. The sub-passage 25 is open while the sub-passage 26 is closed at the level of the upper edge of the plate 24 by a closing semi-bar 27. Just below the latter, the sub-passage 26 contains an outlet distributor 28 formed (FIG. 5) by an oblique corrugated fin 29 and a horizontal corrugated fin 30, the latter opening onto a lateral semi-opening 31. All of the semi-openings are capped by an outlet box 32.

In operation, the diphase fluid F is accelerated when it arrives in the sub-passage 25 and then suddenly decelerated when it flows beyond the lower edge of the plate 24. The vapour phase $F_v$ rises in the sub-passage 26 and is then discharged through the distributor 28 and the box 32 while the liquid phase $F_L$ trickles down and accumulates on the lower bar 23 and is then discharged laterally through an outlet box 33.

Figure 7:
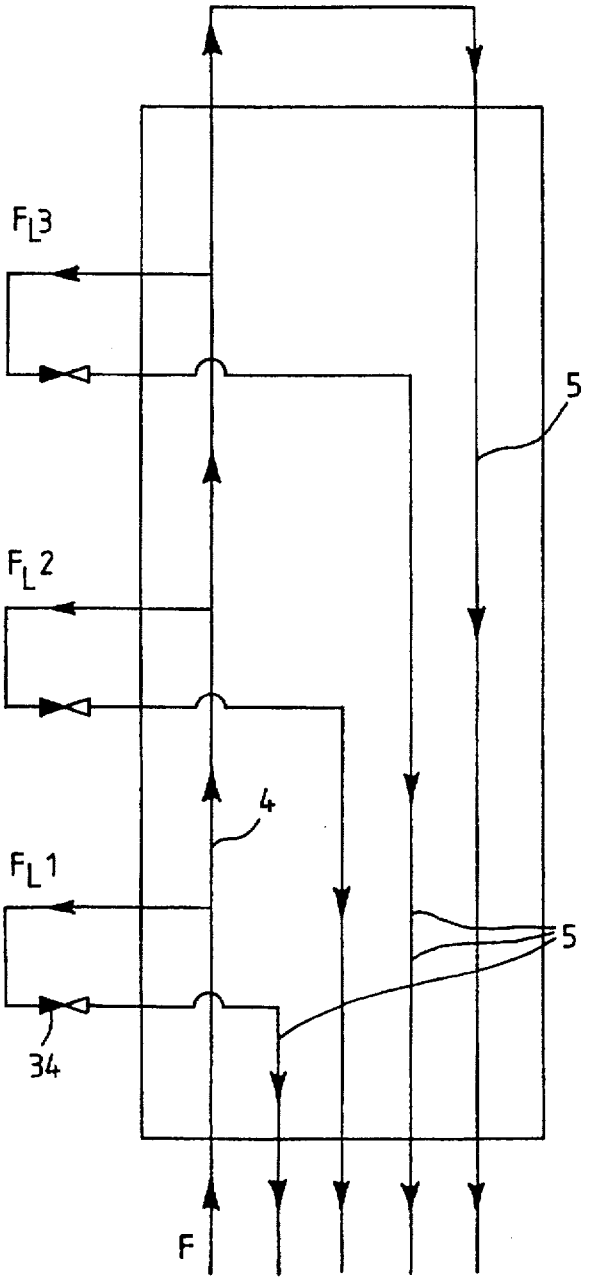
FIG. 7 is a diagrammatic illustration of the application of a heat exchanger according to the invention in the cryogenic purification of a gas.

FIG. 7 illustrates a general diagram of the purification of a gas F under pressure in a heat exchanger 1 according to the invention, by condensation of the heavy impurities thereof. The gas F circulates upwardly in the passage 4 of the exchanger. At several levels, a condensed fraction $F_{L1}$, $F_{L2}$, $F_{L3}$ is drawn off, expanded in an expansion valve 34 and returned in a counter-current manner, that is, downwardly, roughly at the same level of the exchanger, to the passages 5 for producing a cold state. At the cold end of the exchanger, which is its upper end, the purified gas F is returned is a counter-current manner to the passages 5 for recovering the sensible heat thereof.

Figure 8:
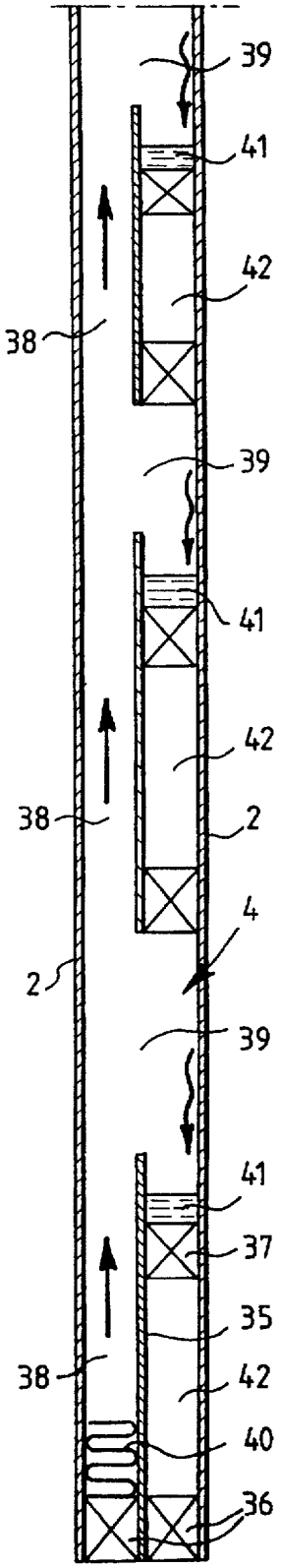
FIG. 8 is a diagrammatic illustration of the structure of the exchanger shown in FIG. 7.

In this process, the two phases of the fluid F in the course of partial condensation must be separated at each level at which a liquid fraction is desired to be drawn off. This may be achieved by the arrangement shown in FIG. 8 which will now be described.

Each passage 4 is subdivided within its thickness on the major part of its height by intermediate spaced-apart plates 35. The lower plate 35 extends from two lower closing semi-bars 36 and, on one side, (the right side in FIG. 8), the semi-passage it defines is closed by an upper closing semi-bar 37 situated at a short distance below the upper edge of the plate 35. Likewise, each intermediate plate 35 comprises, on the same side, a lower closing semi-bar 36 and an upper closing semi-bar 37 arranged in a similar manner.

It can therefore been seen that each passage 4 comprises an active part 38 (the left part in FIG. 8) for the upward circulation of the fluid F, whose thickness is one-half (or in an alternative embodiment, a different fraction) of the distance between the two plates 2 defining this passage, while it is equal to this distance only in the regions 39 separating the intermediate plates 35.

Thus, in operation, the fluid F, introduced at the base of the passage 4 through a distributor 40, circulates at relatively high velocity in the lower region 38, then suddenly decelerates in the first region 39, then accelerates in the second region 38, and so on. In this way, the successive liquid phases corresponding to increasingly lighter impurities, are separated in the regions 39. Owing to the upward velocity of the fluid in the regions 38, the liquids flow in the calm part of the regions 39, that is, in their right half, and collect in the space 41 defined above the bars 37. The latter may be inclined, as before, to facilitate the lateral discharge of the liquids.

The spaces 42 between each pair of semi-bars 36, 37 may be inactive or may be employed for the circulation of appropriate fluids.

What is claimed is:

1. Heat exchanger with brazed plates, comprising in combination: a stack of plates, corrugated fins-spacers separating said plates, and a group of generally flat-shaped passages defined by said plates, said group of passages comprising a series of first passages for circulation of a diphase fluid, a series of second passages for circulation of a heating or refrigerating fluid, each first passage being adjacent to at least one second passage for circulation of said heating or refrigerating fluid, at least one of said first passages comprising, in at least one region along a length thereof, an increase in cross section of said at least one first passage, and means for receiving and discharging one of the two phases of said diphase fluid.

2. Heat exchanger according to claim 1, having an upward circulation of said diphase fluid, wherein one of said plates defining said first passage and an opposite plate of said adjacent second passage for circulation of said other fluid, are upwardly extended beyond an upper end of a common plate between said two passages, which common plate extends above an upper closing bar of said adjacent second passage.

3. Heat exchanger according to claim 1, having an upward circulation of said diphase fluid, and comprising upper closing bars defining upper ends of said second passages, all said plates being upwardly extended beyond said upper closing bars, and at least some of said plates, except for end plates, being provided with apertures above the level of said closing bars.

4. Heat exchanger according to claim 2, comprising, above said plates an upper dome for receiving a gas phase of said diphase fluid.

5. Heat exchanger according to claim 3, comprising, above said plates an upper dome for receiving a gas phase of said diphase fluid.

6. Heat exchanger according to claim 2, comprising, at an upper end thereof, in each gap between plates, a outlet vapour collector outlet distributor which opens onto an outlet opening, and a vapour collector box which caps all said outlet openings.

7. Heat exchanger according to claim 3, comprising, at an upper end thereof, in each gap between plates, a vapour collector outlet distributor which opens onto an outlet opening, and a vapour collector box which caps all said outlet openings.

8. Heat exchanger according to claim 2 wherein said upper closing bars are inclined.

9. Heat exchanger according to claim 1, wherein said first passage comprises, on the upstream side of said region, an intermediate plate which reduces the free cross section up to said region and which forms, with a closing semi-bar, a cavity for receiving one of the two phases of said diphase fluid.

10. Heat exchanger according to claim 9, having a downward circulation of said diphase fluid, wherein said cavity is upwardly defined by said closing semi-bar and contains, below said closing semi-bar, an outlet distributor which laterally opens onto a vapour outlet opening.

11. Heat exchanger according to claim 10, wherein said region is in the neighbourhood of the lower end of said first passage, and said passage is closed at the base thereof by a lower closing bar which extends laterally to a liquid outlet opening.

12. Heat exchanger according to claim 11, wherein said lower closing bar is inclined.

13. Heat exchanger according to claim 9, having an upward circulation of said diphase fluid, wherein said cavity is open toward the upper end and is downwardly defined by said closing semi-bar.

14. Heat exchanger according to claim 13, wherein said closing semi-bar is inclined.

15. Heat exchanger according to claim 14, wherein said first passage comprises a plurality of intermediate plates which are spaced apart along the length thereof.

16. Process for treating a diphase fluid in a heat exchanger which comprises brazed plates defining passages for circulation of a diphase fluid, said process comprising providing in at least one region along a length of each passage for circulation of said diphase fluid a cross section of the passage for said diphase fluid which is substantially increased, and means for receiving one of the two phases of said diphase fluid.

* * * * *